US009486052B2

(12) United States Patent
Kemeny, Jr.

(10) Patent No.: US 9,486,052 B2
(45) Date of Patent: Nov. 8, 2016

(54) NAIL POLISH CONTAINER

(71) Applicant: Aurel Tony Kemeny, Jr., Anaheim, CA (US)

(72) Inventor: Aurel Tony Kemeny, Jr., Anaheim, CA (US)

( * ) Notice: Subject to any disclaimer, the term of this patent is extended or adjusted under 35 U.S.C. 154(b) by 0 days.

(21) Appl. No.: 14/858,610

(22) Filed: Sep. 18, 2015

(65) Prior Publication Data

US 2016/0081450 A1 Mar. 24, 2016

Related U.S. Application Data

(60) Provisional application No. 62/052,325, filed on Sep. 18, 2014.

(30) Foreign Application Priority Data

Mar. 12, 2015 (TW) ..... 104107990 A
Aug. 11, 2015 (CN) ..... 2015 1 0488202

(51) Int. Cl.
*B43K 5/12* (2006.01)
*A45D 34/00* (2006.01)
*A45D 34/04* (2006.01)
*B65D 25/20* (2006.01)

(52) U.S. Cl.
CPC ..... *A45D 34/00* (2013.01); *A45D 34/04* (2013.01); *A45D 34/045* (2013.01); *B65D 25/20* (2013.01); *A45D 2034/007* (2013.01)

(58) Field of Classification Search
CPC . A45D 3024/007; A45D 34/00; A45D 34/04
USPC ..... 401/194; 206/457, 458
See application file for complete search history.

(56) References Cited

U.S. PATENT DOCUMENTS

| | | | |
|---|---|---|---|
| 2,195,495 | A | 4/1940 | Popp |
| 2,237,162 | A | 4/1941 | Robinson |
| 2,340,900 | A | 2/1944 | Robinson |
| 3,451,399 | A | 6/1969 | Peare |
| 4,373,632 | A | 2/1983 | Vanzandt |
| 5,529,417 | A | 6/1996 | Burrlader |
| 6,202,386 | B1 | 3/2001 | Jones et al. |
| 7,185,452 | B2 | 3/2007 | Brown |
| 8,528,739 | B2 | 9/2013 | Haile |
| 2007/0227934 | A1 | 10/2007 | Fracasso et al. |
| 2008/0138140 | A1 | 6/2008 | Barclay |

FOREIGN PATENT DOCUMENTS

| | | | |
|---|---|---|---|
| KR | 200370276 | Y1 | 12/2004 |
| KR | 101264203 | B1 | 5/2013 |

OTHER PUBLICATIONS

Written Opinion of the International Search Authority for PCT/US2015/050998 mailed Feb. 18, 2016.

*Primary Examiner* — Jennifer C Chiang
(74) *Attorney, Agent, or Firm* — Kutak Rock LLP; Marcellus A. Chase

(57) ABSTRACT

A nail polish container is disclosed. The nail polish container includes a housing with a recessed portion and a nail-like component. The nail-like component is shaped and sized to substantially resemble a human nail, and the nail-like component is configured to moveably attached to the housing, such that the nail-like component is moveable between a retracted state in which the nail-like component is substantially accommodated within the recessed portion and an extended state in which at least a portion of the nail-like component protrudes away from the recessed portion. The nail polish container can allow user to apply the nail treatment to the nail-like component and positions the treated nail-like component in close proximity to the user's actual nail to simulate the visual appearance of the user's own nail if it had been treated.

8 Claims, 5 Drawing Sheets

NAIL POLISH CONTAINER

CROSS-REFERENCE TO RELATED APPLICATIONS

This U.S. application claims priority to U.S. provisional patent application Ser. No. 62/052,325, filed on Sep. 18, 2014, Taiwan patent application no. 104107990, filed on Mar. 12, 2015 and China patent application no. 201510488202.X, filed on Aug. 11, 2015, the entire disclosures of which are incorporated herein by reference.

FIELD

The present inventive concept relates generally to fluid containers for use with nail polish, color or treatment. More particularly, the present inventive concept is concerned with a nail polish container that includes a housing with a recessed portion and a nail-like component, where the nail-like component is moveable between an extended state and a retracted state.

BACKGROUND

Adorning fingernails and toenails with various nail surface treatments to enhance aesthetics is popular. People of all ages routinely alter the appearance of their nails to be more appealing visually. Nail treatments may include polish, gel, enamel, colored, uncolored, or other treatments. Nail treatments often are distributed in liquid form in small bottles that include a container and lid.

One common challenge with nail treatment fluids and their containers is that there is a disconnect between the visual appearance of the nail treatment fluid in liquid form in the container compared to the visual appearance of the nail treatment fluid after it has been applied to a nail and allowed to dry or set. This difficulty is particularly disruptive when dealing with colors with subtle nuances. Often, the appearance (shade, hue, value, chroma, luster, opacity, etc.) of nail treatments in the bottle differs from that of the applied nail treatment.

Another common challenge is that some users experience difficulty visualizing how various nail treatments will look after proper application. Some users prefer to see the treatment applied to their nail before committing to a particular treatment.

SUMMARY

In order to address these and other shortcomings, a nail polish container is provided that includes a nail-like component that is sized and shaped similar to an unguis. A user applies the nail treatment to the nail-like component and positions the treated nail-like component in close proximity to the user's actual nail to simulate the visual appearance of the user's own nail if it had been treated. The nail-like component of each bottle of nail treatment needs to be treated only once. The treated nail-like component remains affixed to the bottle and/or lid of nail treatment and the user (or any other subsequent user) can visualize the appearance of that particular nail treatment on any given subsequent nail.

Therefore, one objective is to provide a housing of a nail polish container to achieve the effect of allowing a user to display the actual color and appearance of the fluid within the container on an appendage that simulates a fingernail or toenail in size and shape.

A nail polish container according to the present inventive concept comprises a housing with a recessed portion and a nail-like component. The nail-like component is shaped and sized to substantially resemble a human unguis, and the nail-like component is configured to moveably attach to the housing, such that the nail-like component is moveable between a retracted state in which the nail-like component is substantially accommodated within the recessed portion and an extended state in which at least a portion of the nail-like component protrudes away from the recessed portion.

In one embodiment, the housing is disposed with a first groove and a second groove parallel to each other near a bottom surface of the recessed portion, and a first edge of the nail-like component is in compliment with the first groove and a second edge of the nail-like component opposite to the first edge is in compliment with the second groove, and the nail-like component is configured to slide along an axis parallel to the first groove and the second groove.

In another embodiment, the housing is disposed with a slot on a bottom surface of the recessed portion, and the nail-like component further includes a stem extending from an underside of the nail-like component, the stem is sized and shaped to fit within the slot, and an anchor extends from the stem, the anchor is sized and shaped to be larger than a width of the slot. The anchor is configured to pass through the slot and positioned on an interior side of the housing, such that the anchor keeps the nail-like component attached to the housing while allowing the nail-like component to slide a full length of the slot along an axis parallel to the slot.

In another embodiment, the housing is disposed with a hole on a bottom surface of the recessed portion, and the nail-like component further includes a stem extending from an underside of the nail-like component, where the stem is sized and shaped to fit within the hole, an anchor extends from the stem, and the anchor is sized and shaped to be larger than a width of the hole. The anchor is configured to be positioned on an interior side of the housing such that the anchor keeps the nail-like component attached to the housing while allowing the nail-like component to move between the retracted state and the extended state.

In another embodiment, the anchor keeps the nail-like component attached to the housing while allowing the nail-like component to rotate out away from the housing to the extended state, with the stem and the anchor acting as a fulcrum.

In another embodiment, the anchor keeps the nail-like component attached to the housing while allowing the nail-like component to rotate about the housing to the extended state, with the stem and the anchor acting as an axis of rotation.

In another embodiment, while in the retracted state, the size and shape of the nail-like component substantially compliments the housing, as if the nail-like component is a portion of the housing.

In another embodiment, the nail-like component is detachably attached to the housing.

In another embodiment, the housing is configured as a part of a lid of the nail polish container.

In another embodiment, the housing is configured as a part of a fluid-accommodating-structure of the nail polish container.

The nail polish container according to the present inventive concept has the following advantages: (1) It allows users to establish a connect between the visual appearance of the nail treatment fluid in liquid form in the container compared to the visual appearance of the nail treatment fluid after it has been applied to a nail and allowed to dry or set.

(2) It aids users to visualize how various nail treatments will look after proper application. The users will be able to simulate the treatment applied to their nail before committing to a particular treatment.

The foregoing and other objects are intended to be illustrative of the invention and are not meant in a limiting sense. Many possible embodiments of the invention may be made and will be readily evident upon a study of the following specification and accompanying drawings comprising a part thereof. For example, dimensional values included herein are provided for exemplary purposes, and embodiments of the present invention contemplate tourniquets or tourniquet components having a various dimensional values. Furthermore, various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DRAWINGS

Preferred embodiments of the invention, illustrative of the best modes in which the applicant has contemplated applying the principles, are set forth in the following description and are shown in the drawings, exhibits and/or appendixes.

It is to be understood that the attached drawings are for purposes of illustration and may not be to scale.

DETAILED DESCRIPTION

The following detailed description references the accompanying drawings that illustrate specific exemplary embodiments in which the inventive concept can be practiced. The embodiments are intended to describe various aspects in sufficient detail to enable those skilled in the art to practice the invention. Other embodiments can be utilized and changes can be made without departing from the scope of the present invention. The following detailed description is, therefore, not to be taken in a limiting sense.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The general inventive concept is an improvement to existing packaging (i.e., the housing of a nail polish container) for nail polish, color or treatment. The general inventive concept is incorporated into the bottle or cap of the nail polish container. Although exemplary embodiments of the housing of the present invention are shown in the accompanying figures and described below with respect to a bottle lid, one skilled in the art will appreciate that similar structural features may be incorporated into a bottle (apart from the bottle lid), where the bottle and the bottle lid are two aspects of the housing of the nail polish container. In addition, the housing may also be configured as a part of a lid of the nail polish container, or the housing may be configured as a part of a fluid-accommodating-structure of the nail polish container.

Figure 1:
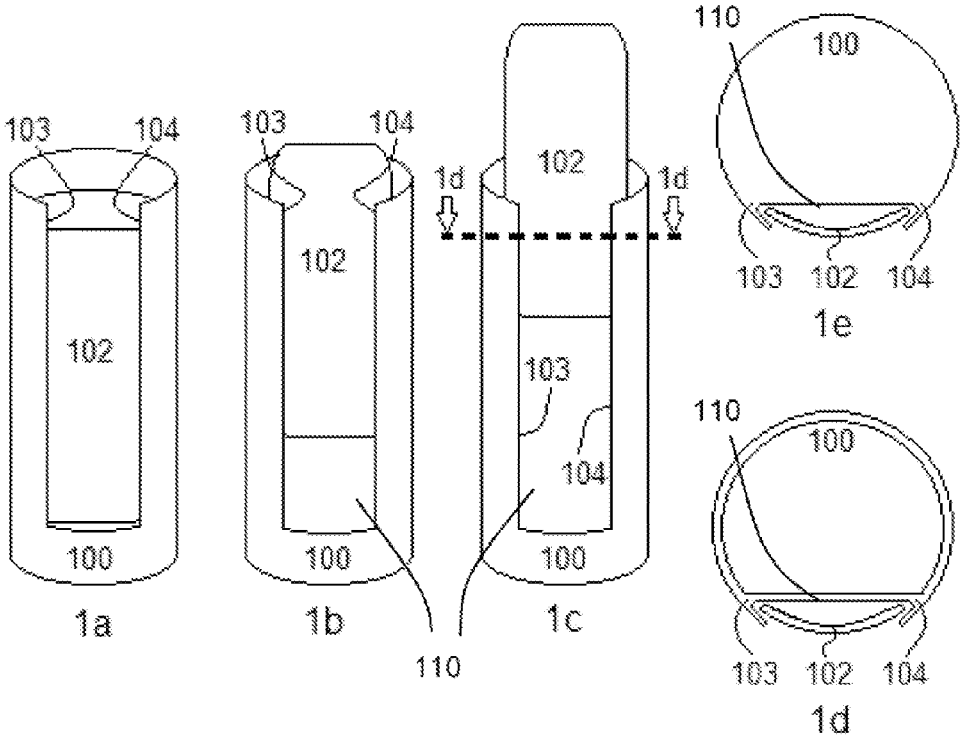
FIG. 1 shows an embodiment with a sliding nail.

FIG. 1 shows an embodiment of the present inventive concept having a sliding nail. More specifically, FIG. 1*a* shows a housing 100 with a nail-like component 102 in a retracted state. FIG. 1*b* shows the housing 100 with the nail-like component 102 in a partially retracted or partially extended state. FIG. 1*c* shows the housing 100 with the nail-like component 102 in an extended state. FIG. 1*d* shows a cross-section of FIG. 1*c*, where the housing 100 is hollow. FIG. 1*e* shows an embodiment where the cross-section 1*d* of the housing 100 is solid (i.e. not hollow).

Referring to FIG. 1*a* to FIG. 1*e*, an embodiment of a housing 100 with a recessed portion 110 is shown. In this embodiment, the housing 100 serves as, but is not limited to, a lid of a nail polish container. The housing 100 includes a nail-like component 102 that is sized and shaped to substantially resemble an unguis, such as a human fingernail or toenail. The housing 100 further includes a first groove 103 and second groove 104, parallel to one another on two sides of the recessed portion 110. One edge of the nail-like component 102 is in compliment with the first groove 103 and an opposite edge of the nail-like component 102 is in compliment with the second groove 104. The nail-like component 102 slides along an axis parallel to the first groove 103 and second groove 104. The nail-like component 102 slides from a retracted state to an extended state, with various partial states between. Here, the nail-like component 102 is able to change between the retracted state and the extended state. The nail-like component 102 is substantially accommodated within the recessed portion 110 in the retracted state, and at least a portion of the nail-like component 102 protrudes away from the recessed portion 110 in the extended state.

Figure 2:
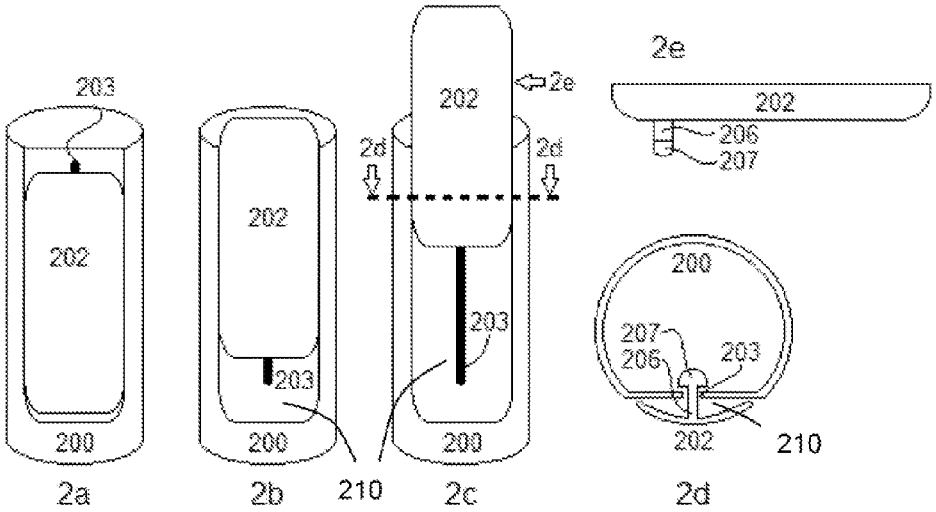
FIG. 2 shows another embodiment with a sliding nail.

FIG. 2 shows another embodiment with a sliding nail. More specifically, FIG. 2*a* shows a housing 200 with a nail-like component 202 in a retracted state. FIG. 2*b* shows the housing 200 with the nail-like component 202 in a partially retracted or partially extended state. FIG. 2*c* shows the housing 200 with the nail-like component 202 in an extended state. FIG. 2*d* shows a cross-section of FIG. 2*c*, where the housing 200 is hollow. FIG. 2*e* shows a side view of the nail-like component 202 with a stem 206 and an anchor 207.

Referring to FIG. 2*a* to FIG. 2*e*, an embodiment of a housing 200 with a recessed portion 210 is shown. In this embodiment, the housing 200 serves as, but is not limited to, a lid of a nail polish container. The housing 200 includes a nail-like component 202 that is sized and shaped to substantially resemble a human fingernail or toenail. The housing 200 further includes a slot 203 on a bottom surface of the recessed portion 210. The nail-like component 202 includes a stem 206 extending from an underside of the nail-like component 202 and sized and shaped to fit within the slot 203 and slide to various points in the slot 203. The nail-like component 202 also includes an anchor 207 extending from the stem 206 and sized and shaped to be larger than the width of the slot 203. The anchor 207 is configured to pass through the slot 203 and positioned on an interior side of the housing 200 such that the anchor 207 keeps the nail-like component 202 attached to the housing 200 while allowing the nail-like component 202 to slide the full length of the slot 203. The nail-like component 202 slides along an axis parallel to the slot 203. The nail-like component 202 slides from a retracted state to an extended state, with various partial states between. Here, the nail-like component 202 is able to slide and move between the retracted state and the extended state. The nail-like component 202 is substantially accommodated within the recessed portion 210 in the retracted state, and at least a portion of the nail-like component 202 protrudes away from the recessed portion 210 in the extended state.

Figure 3:
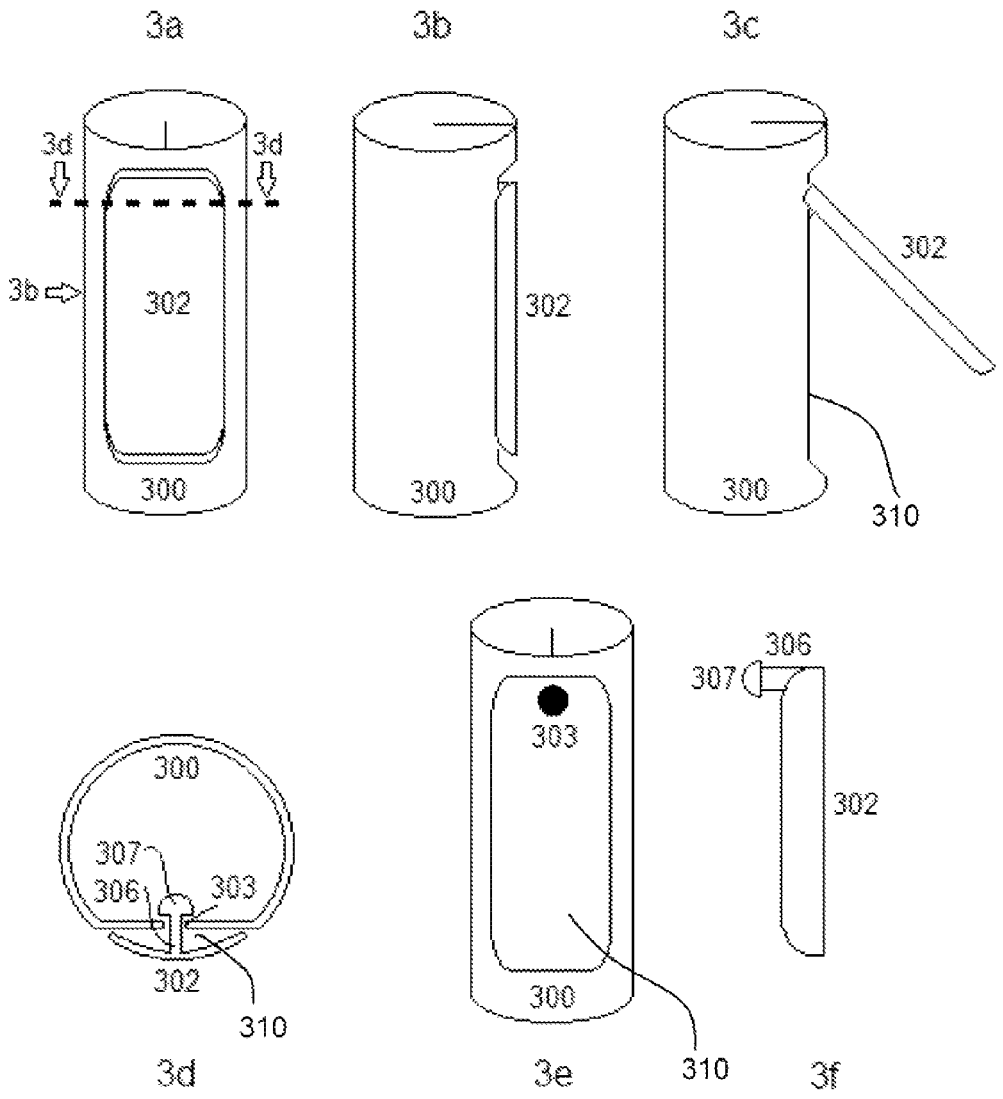
FIG. 3 shows an embodiment with a nail that tilts out.

FIG. 3 shows an embodiment where the nail tilts out. More specifically, FIG. 3*a* shows a housing 300 with a nail-like component 302 in a retracted state. FIG. 3*b* shows a side view of FIG. 3*a*, with the nail-like component 302 in a retracted state. FIG. 3*c* shows the side view of FIG. 3*a*, with the nail-like component 302 in an extended state. FIG. 3*d* shows a cross-section of FIG. 3*a*, where the housing 300 is hollow. FIG. 3*e* shows the bottle lid of FIG. 3*a* with the nail-like component 302 removed such that the hole 303 is shown. FIG. 3*f* shows a side view of the nail-like component 302 with stem 306 and anchor 307.

Referring to FIG. 3*a* to FIG. 3*f*, an embodiment of a housing 300 with a recessed portion 310 is shown. In this embodiment, the housing 300 serves as, but is not limited to, a lid of a nail polish container. The housing 300 includes a nail-like component 302 that is sized and shaped to substantially resemble a human fingernail or toenail. The housing 300 further includes a hole 303 on a bottom surface of the recessed portion 310. The nail-like component 302 includes a stem 306 extending from an underside of the nail-like component 302 and sized and shaped to fit within the hole 303. The nail-like component 302 also includes an anchor 307 extending from the stem 306 and sized and shaped to be larger than the width of the hole 303. The anchor 307 is configured to be positioned on an interior side of the housing 300 such that the anchor 307 keeps the nail-like component 302 attached to the housing 300 while allowing the nail-like component 302 to rotate or tilt out away from the housing 300 to the extended state, with the stem 306 and anchor 307 acting as fulcrum. The nail-like component 302 rotates from a retracted state to an extended state, with various partial states between. Here, the nail-like component 302 is able to rotate and change between the retracted state and the extended state. The nail-like component 302 is substantially accommodated within the recessed portion 310 in the retracted state, and at least a portion of the nail-like component 302 protrudes away from the recessed portion 310 in the extended state.

Figure 4:
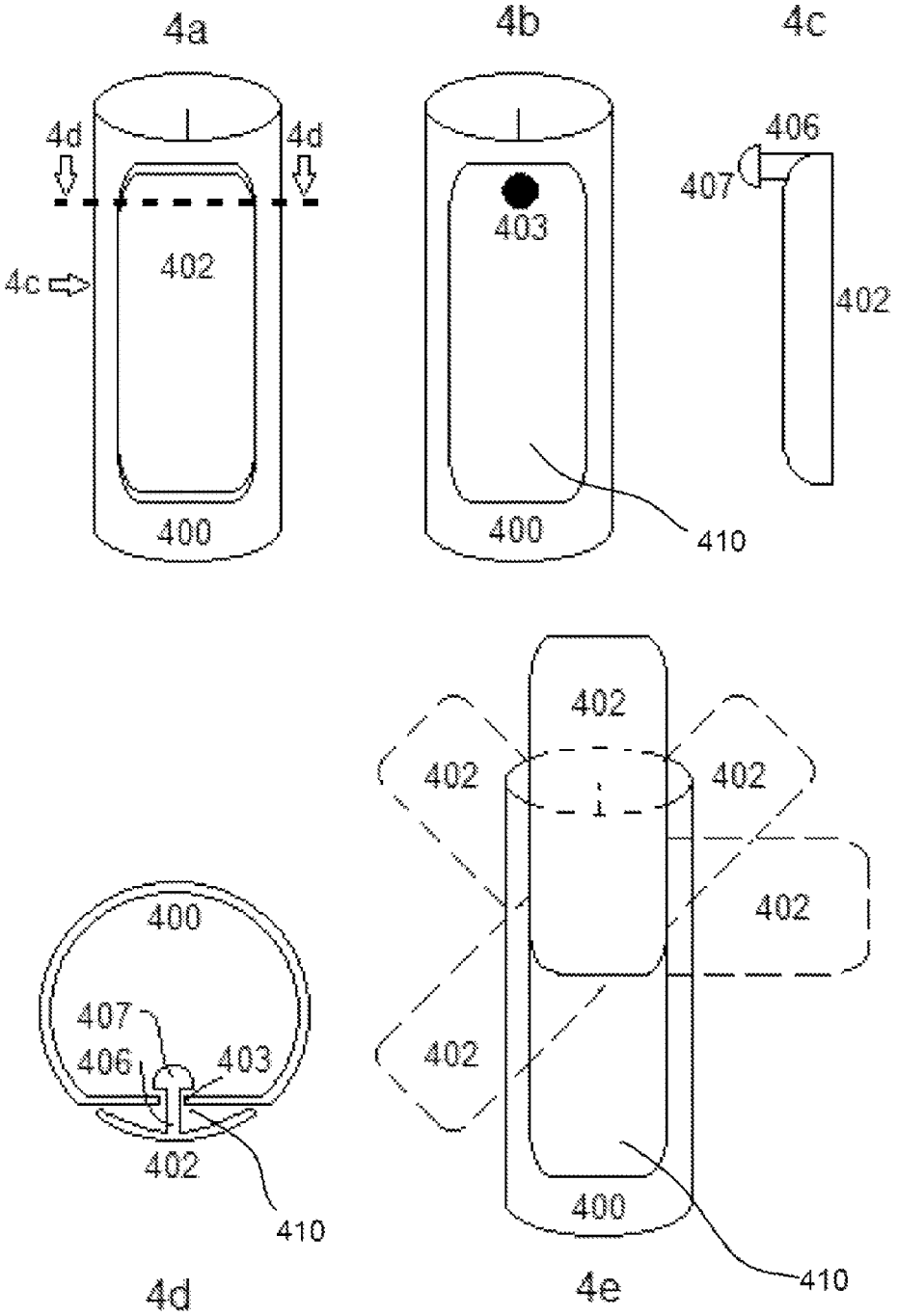
FIG. 4 shows an embodiment with a nail that rotates out.

FIG. 4 is an embodiment where the nail rotates out. More specifically, FIG. 4*a* shows the housing 400 with the nail-like component 402 in a retracted state. FIG. 4*b* shows the bottle lid of FIG. 4*a* with the nail-like component 402 removed such that the hole 403 is shown. FIG. 4*c* shows a side view of the nail-like component 402 with stem 406 and anchor 407. FIG. 4*d* shows a cross-section of FIG. 4*a*, where the housing 400 is hollow. FIG. 4*e* shows the housing 400 with the nail-like component 402 in an extended state (solid lines) and various partial states (dotted lines).

Referring to FIG. 4, an embodiment of a housing 400 with a recessed portion 410 is shown. In this embodiment, the housing 400 serves as, but is not limited to, a lid of a nail polish container. The housing 400 includes a nail-like component 402 that is sized and shaped to substantially resemble a human fingernail or toenail. The housing 400 further includes a hole 403 on a bottom surface of the recessed portion 410. The nail-like component 402 includes a stem 406 extending from an underside of the nail-like component 402 and sized and shaped to fit within the hole 403. The nail-like component 402 also includes an anchor 407 extending from the stem 406 and sized and shaped to be larger than the width of the hole 403. The anchor 407 is configured to be positioned on an interior side of the housing 400 such that the anchor 407 keeps the nail-like component 402 attached to the housing 400 while allowing the nail-like component 402 to rotate about the housing 400 with the stem 406 and anchor 407 acting as the axis of rotation in the extended state. The nail-like component 402 rotates from a retracted state to an extended state, with various partial states between.

Figure 5:
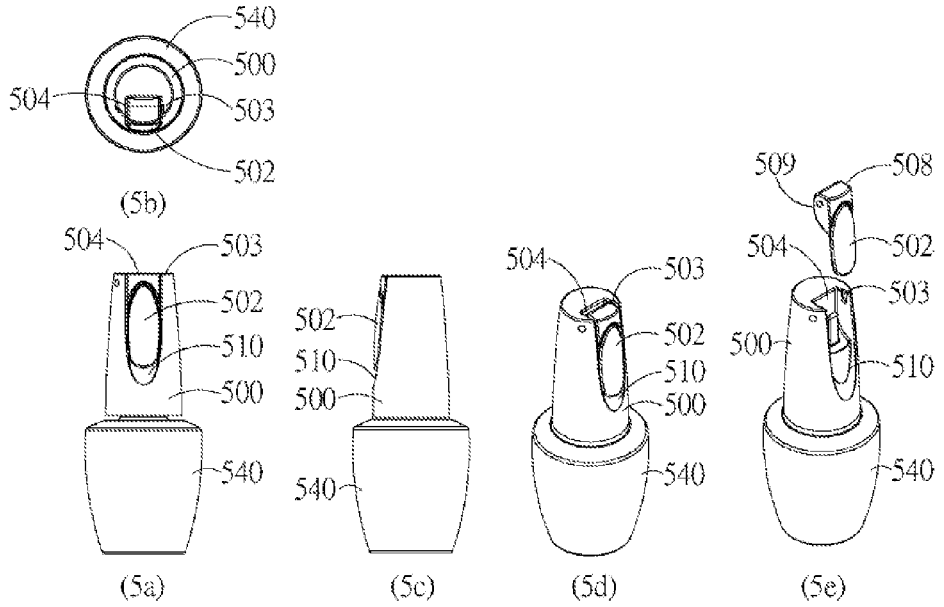
FIG. 5 shows an embodiment with a tilting nail that is detachable.

FIG. 5 is an embodiment with a detachable tilting nail. More specifically, FIG. 5*a* shows a front view, including a housing 500 with a nail-like component 502 in a retracted state and a bottle 540. FIG. 5*b* shows a top view, including the housing 500 with the nail-like component 502 in a retracted state and the bottle 540. FIG. 5*c* shows a side view, including the housing 500 with the nail-like component 502 in a retracted state and bottle 540. FIG. 5*d* shows a perspective view, including the housing 500 with the nail-like component 502 in a retracted state and bottle 540. FIG. 5*e* shows an exploded view, including the housing 500 with the nail-like component 502 separated from the bottle 540.

Referring to FIG. 5*a* to FIG. 5*e*, an embodiment of a housing 500 with a recessed portion 510 is shown. In this embodiment, the housing 500 serves as, but is not limited to, a lid of a nail polish container. The housing 500 includes a nail-like component 502 that is sized and shaped to substantially resemble a human fingernail or toenail. The housing 500 further includes a first notch 503 and second notch 504, positioned opposite one another on two opposing sides of the recessed portion 510. On one side of the nail-like component 502 is a first protrusion 508 sized and shaped to engage complimentarily with the first notch 503. On the opposite side of the nail-like component 502 is a second protrusion 509 sized and shaped to engage complimentarily with the second notch 504. The first protrusion 508 and second protrusion 509 engage with the first notch 503 and second notch 504, respectively, such that the nail-like component 502 removably attaches to the housing 500 while allowing the nail-like component 502 to rotate out away from the housing 500 with the notches 503 and 504 and protrusions 508 and 509 acting as fulcrum. The nail-like component 502 rotates from a retracted state to an extended state, with various partial states between. Here, the nail-like component 502 is able to rotate and change between the retracted state and the extended state. The nail-like component 502 is substantially accommodated within the recessed portion 510 in the retracted state, and at least a portion of the nail-like component 502 protrudes away from the recessed portion 510 in the extended state.

Figure 6:
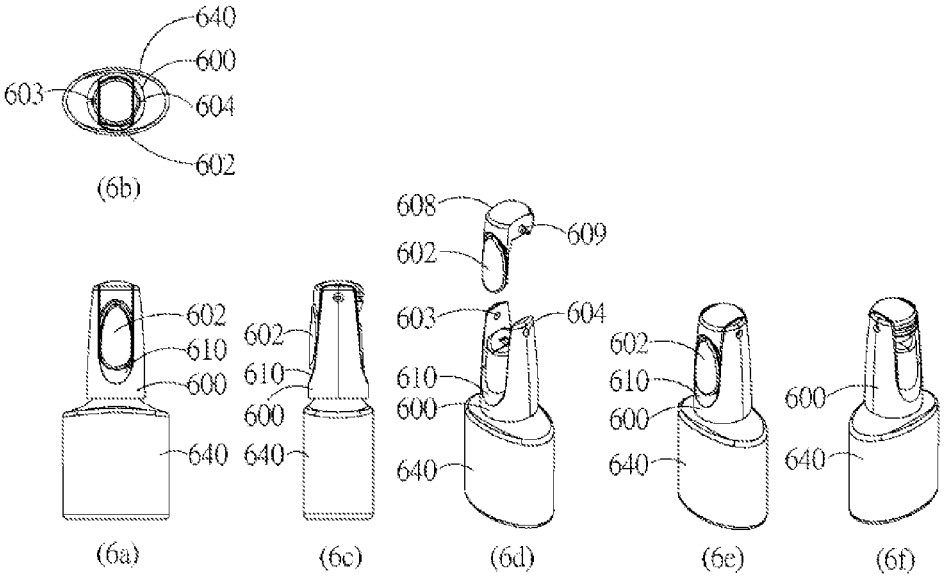
FIG. 6 shows another embodiment with a tilting nail that is detachable.

FIG. 6 is another embodiment with a detachable tilting nail. More specifically, FIG. 6*a* shows a front view, including a housing 600 with a nail-like component 602 in a retracted state and a bottle 640. FIG. 6*b* shows a top view, including the housing 600 with the nail-like component 602 in a retracted state and the bottle 640. FIG. 6*c* shows a side view, including the housing 600 with the nail-like component 602 in a retracted state and bottle 640. FIG. 6*d* shows an exploded view, including the housing 600 with the nail-like component 602 separated from the bottle 640. FIG. 6*e* shows a perspective view, including the housing 600 with the nail-like component 602 in a retracted state and bottle 640. FIG. 6*f* shows a rear perspective view, including the housing 600 and bottle 640.

Referring to FIG. 6*a* to FIG. 6*f*, an embodiment of a housing 600 with a recessed portion 610 is shown. In this embodiment, the housing 600 serves as, but is not limited to, a lid of a nail polish container. The housing 600 includes a nail-like component 602 that is sized and shaped to substantially resemble a human fingernail or toenail. The housing 600 further includes a first notch 603 and second notch 604, positioned opposite one another on two sides of the recessed portion 610. On one side of the nail-like component 602 is a first protrusion 608 sized and shaped to engage complimentarily with the first notch 603. On the opposite side of the nail-like component 602 is a second protrusion 609 sized and shaped to engage complimentarily with the second notch 604. The first protrusion 608 and second protrusion 609 engage with the first notch 603 and second notch 604, respectively, such that the nail-like component 602 removably attaches to the housing 600 while allowing the nail-like component 602 to rotate out away from the housing 600 with the notches 603 and 604 and protrusions 608 and 609 acting as fulcrum. The nail-like component 602 rotates from a retracted state to an extended state, with various partial states between. Here, the nail-like component 602 is able to rotate and change between the retracted state and the extended state. The nail-like component 602 is substantially accommodated within the recessed portion 610 in the retracted state, and at least a portion of the nail-like component 602 protrudes away from the recessed portion 610 in the extended state.

Figure 7:
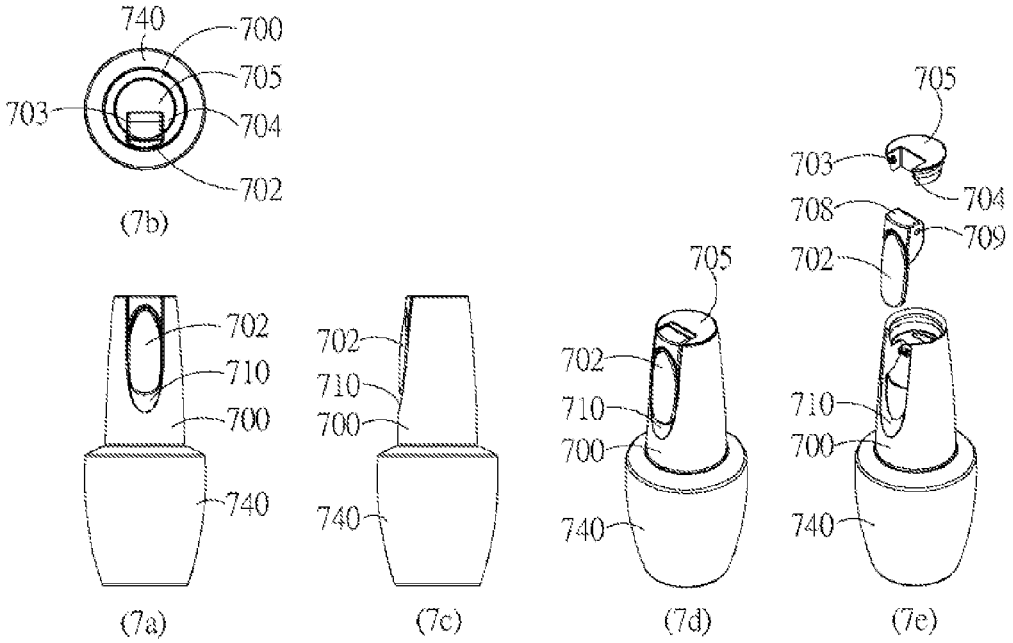
FIG. 7 shows another embodiment with a tilting nail that is detachable.

FIG. 7 is another embodiment with a detachable tilting nail. More specifically, FIG. 7*a* shows a front view, including a housing 700 with a nail-like component 702 in a retracted state and a bottle 740. FIG. 7*b* shows a top view, including the housing 700 with the nail-like component 702 in a retracted state and the bottle 740. FIG. 7*c* shows a side view, including the housing 700 with the nail-like component 702 in a retracted state and bottle 740. FIG. 7*d* shows a perspective view, including the housing 700 with the nail-like component 702 in a retracted state and bottle 740. FIG. 7*e* shows an exploded view, including the housing 700 with the nail-like component 702 separated from the bottle 740, and a cap component 705 that engages the nail-like component 702 and removably attaches the nail-like component 702 to the housing 700.

Referring to FIG. 7*a* to FIG. 7*e*, an embodiment of a housing 700 with a recessed portion 710 is shown. In this embodiment, the housing 700 serves as, but is not limited to, a lid of a nail polish container. The housing 700 includes a nail-like component 702 that is sized and shaped to substantially resemble a human fingernail or toenail. The housing 700 further includes a cap component 705 that engages with the nail-like component 702 to removably attach the nail-like component 702 to the housing 700. The cap component 705 further includes a first notch 703 and second notch 704, positioned opposite one another. On one side of the nail-like component 702 is a first protrusion 708 sized and shaped to engage complimentarily with the first notch 703. On the opposite side of the nail-like component 702 is a second protrusion 709 sized and shaped to engage complimentarily with the second notch 704. The first protrusion 708 and second protrusion 709 engage with the first notch 703 and second notch 704, respectively, and the cap component 705 engages with the top of the housing 700 such that the nail-like component 702 removably attaches to the cap component 705 while allowing the nail-like component 702 to rotate out away from the housing 700 with the notches 703 and 704 and protrusions 708 and 709 acting as fulcrum. The nail-like component 702 rotates from a retracted state to an extended state, with various partial states between. Here, the nail-like component 702 is able to rotate and change between the retracted state and the extended state. The nail-like component 702 is substantially accommodated within the recessed portion 710 in the retracted state, and at least a portion of the nail-like component 702 protrudes away from the recessed portion 710 in the extended state.

In addition, in the above mentioned embodiments, when in the retracted state, the nail-like component 102, 202, 302, 402, 502, 602, and 702 may be substantially blended into the housing 100, 200, 300, 400, 500, 600, and 700 (i.e., the bottle lid of the nail container) as if the nail-like component 102, 202, 302, 402, 502, 602, and 702 is a portion of the housing 100, 200, 300, 400, 500, 600, and 700, respectively. In other preferred embodiments, the nail-like component 102, 202, 302, 402, 502, 602, and 702 is blended into the bottle (not shown) as a portion of the bottle, and the nail-like component 102, 202, 302, 402, 502, 602, and 702 may detachably attached to the housing.

The nail polish container, as described herein, can achieve the effect of allowing a user to display the actual color and appearance of the fluid within the container on an appendage that simulates a fingernail or toenail in size and shape. The nail polish container allows a user to apply the nail treatment to the nail-like component and position the treated nail-like component in close proximity to the user's actual nail to simulate the visual appearance of the user's own nail as if it had been treated. The housing and the nail-like component of the nail polish container can allow the users to establish a connect between the visual appearance of the nail treatment fluid in liquid form in the container compared to the visual appearance of the nail treatment fluid after it has been applied to a nail and allowed to dry or set, and can help certain users to visualize how various nail treatments will look after proper application. Users will be able to simulate the treatment applied to their nail before committing to a particular treatment via the nail polish container of the present inventive concept.

While the present general inventive concept has been shown in the drawings and fully described above with particularity and detail in connection with what is presently deemed to be the most practical and preferred embodiment(s), it will be apparent to those of ordinary skill in the art that many modifications thereof may be made without departing from the principles and concepts set forth herein, including, but not limited to, variations in size, materials, shape, form, function and manner of operation, assembly and use.

It is also to be understood that the following claims are intended to cover all of the generic and specific features of the invention herein described, and all statements of the scope of the invention which, as a matter of language, might be said to fall therebetween. Hence, the proper scope of the present general inventive concept should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office, other patent offices, the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. A nail polish container, comprising:

a housing with a recessed portion; and a nail-like component being shaped and sized to resemble a human nail, the nail-like component being configured to moveably attached to the housing such that the nail-like component is moveable between a retracted state in which the nail-like component is accommodated within the recessed portion and an extended state in which at least a portion of the nail-like component protrudes away from the recessed portion, wherein the housing is disposed with a slot on a bottom surface of the recessed portion, and the nail-like component further comprises:

a stem extending from an underside of the nail-like component, the stem being sized and shaped to fit within the slot; and an anchor extending from the stem, the anchor being sized and shaped to be larger than a width of the slot;

wherein the anchor is configured to pass through the slot and positioned on an interior side of the housing, such that the anchor keeps the nail-like component attached to the housing while allowing the nail-like component to slide a full length of the slot along an axis parallel to the slot.

2. A nail polish container, comprising:

a housing is recessed portion, and a nail-like component being shaped and sized to resemble a human nail, the nail-like component being configured to moveably attached to the housing, such that the nail-like component is moveable between a retracted state in which the nail-like component is accommodated within the recessed portion and an extended state in which at least a portion of the nail-like component protrudes away from the recessed portion, wherein the housing is disposed with a hole on a bottom surface of the recessed portion, and the nail-like component further comprises:

a stem extending from an underside of the nail-like component, the stem being sized and shaped to fit within the hole; and an anchor extending from the stem, the anchor being sized and shaped to be larger than a width of the hole;

wherein the anchor is configured to be positioned on an interior side of the housing such that the anchor keeps the nail-like component attached to the housing while allowing the nail-like component to move between the retracted state and the extended state.

3. The nail polish container of claim 2, wherein the anchor keeps the nail-like component attached to the housing while allowing the nail-like component to rotate out away from the housing with the stem and the anchor acting as a fulcrum in the extended state.

4. The nail polish container of claim 2, wherein the anchor keeps the nail-like component attached to the housing while allowing the nail-like component to rotate about the housing with the stem and the anchor acting as an axis of rotation in the extended state.

5. A nail polish container, comprising:

a housing with a recessed portion; and a nail-like component being shaped and sized to resemble a human nail, the nail-like component being configured to moveably attached to the housing, such that the nail-like component is moveable between a retracted state in which the nail-like component is accommodated within the recessed portion and an extended state in which at least a portion of the nail-like component protrudes away from the recessed portion, wherein the housing is disposed with a first notch and a second notch positioned opposite one another on opposing sides of the recessed portion, and a first protrusion on a first side of the nail-like component sized and shaped to engage complimentarily with the first notch and a second protrusion on a second side of the nail-like component sized and shaped to engage complimentarily with the second notch, wherein the first and second notch engage with the first and second protrusion, respectively, to keep the nail-like component attached to the housing while allowing the nail-like component to move between the retracted state and the extended state.

6. The nail polish container of claim 5, wherein the first and second notches engaging with the first and second protrusions keep the nail-like component attached to the housing while allowing the nail-like component to rotate out away from the housing with the notches and protrusions acting as a fulcrum in the extended state.

7. A nail polish container, comprising:

a housing with a recessed portion; and a nail-like component being shaped and sized to resemble a human nail, the nail-like component being configured to moveably attached to the housing, such that the nail-like component is moveable between a retracted state in which the nail-like component is accommodated within the recessed portion and an extended state in which at least a portion of the nail-like component protrudes away from the recessed portion, wherein the housing includes a cap component that is disposed with a first notch and a second notch positioned opposite one another on opposing sides of the cap component, and a first protrusion on a first side of the nail-like component sized and shaped to engage complimentarily with the first notch and a second protrusion on a second side of the nail-like component sized and shaped to engage complimentarily with the second notch, wherein the first and second notch engage with the first and second protrusion, respectively, and the cap component engages with the housing to keep the nail-like component attached to the housing while allowing the nail-like component to change between the retracted state and the extended state.

8. The nail polish container of claim 7, wherein the first and second notches engaging with the first and second protrusions and the cap component engaging with the housing keep the nail-like component attached to the housing while allowing the nail-like component to rotate out away from the housing with the notches and protrusions acting as a fulcrum in the extended state.

* * * * *